US011214030B2

(12) United States Patent
Phillips et al.

(10) Patent No.: US 11,214,030 B2
(45) Date of Patent: Jan. 4, 2022

(54) CORE COMPRESSION AND FEEDER APPARATUS AND METHOD OF USING SAME

(71) Applicant: Industrial Shredders LTD., Berea, OH (US)

(72) Inventors: Richard Mark Phillips, Berea, OH (US); Eric Jason Wallace, Berea, OH (US)

(73) Assignee: Industrial Shredders LTD., Berea, OH (US)

( * ) Notice: Subject to any disclaimer, the term of this patent is extended or adjusted under 35 U.S.C. 154(b) by 48 days.

(21) Appl. No.: 16/356,554

(22) Filed: Mar. 18, 2019

(65) Prior Publication Data

US 2020/0298522 A1 Sep. 24, 2020

Related U.S. Application Data

(60) Provisional application No. 62/643,889, filed on Mar. 16, 2018.

(51) Int. Cl.

| | |
|---|---|
| ***B30B 3/04*** | (2006.01) |
| ***B30B 3/00*** | (2006.01) |
| ***B30B 15/04*** | (2006.01) |
| ***B30B 15/14*** | (2006.01) |

(52) U.S. Cl.

CPC ..... *B30B 3/04* (2013.01); *B30B 3/005* (2013.01); *B30B 15/04* (2013.01); *B30B 15/14* (2013.01)

(58) Field of Classification Search

CPC ..... B30B 3/04; B30B 15/04; B30B 3/005; B30B 3/045; B30B 9/325; B30B 9/326; B02C 4/08; B02C 4/32; B02C 19/0093; B26F 1/24; B26F 2210/11

USPC ..... 198/457.02, 397.05; 193/35 R

See application file for complete search history.

(56) References Cited

U.S. PATENT DOCUMENTS

| | | | | | |
|---|---|---|---|---|---|
| 3,062,460 | A * | 11/1962 | Bunney | B02C 19/0056 | 241/243 |
| 3,643,591 | A * | 2/1972 | Bragg | B02C 18/142 | 100/95 |
| 3,707,909 | A * | 1/1973 | Volkers | B30B 3/04 | 100/170 |
| 5,192,031 | A * | 3/1993 | Gilbert | B30B 9/3046 | 100/176 |
| 5,746,378 | A * | 5/1998 | Beadle | B02C 19/0093 | 241/167 |

(Continued)

FOREIGN PATENT DOCUMENTS

| | | | | |
|---|---|---|---|---|
| WO | WO 2011042803 A1 * | 4/2011 | B30B 3/04 | 29/428 |

*Primary Examiner* — Jimmy T Nguyen

(74) *Attorney, Agent, or Firm* — Benesch, Friedlander, Coplan & Aronoff LLP

(57) ABSTRACT

A core compressor is disclosed that includes a housing, a first pair of rollers and a second pair of rollers, both positioned in the housing. Each of the pair of rollers includes an upper roller and a lower roller. The first pair of the rollers is located proximate to a first end of the core compressor, and the second pair of the rollers is located proximate to a second and opposing end of the core compressor. The upper roller and lower roller of the first pair of rollers are located a first distance apart. The upper roller and lower roller of the second pair of rollers are located a second distance apart. Each roller includes at least one row of teeth extending generally perpendicularly away from the surface of the roller.

14 Claims, 17 Drawing Sheets

(56) References Cited

U.S. PATENT DOCUMENTS 6,131,509 A * 10/2000 Davis ..... B30B 15/08
225/100
8,196,736 B2 * 6/2012 Wagner ..... B65G 13/04
198/781.1

* cited by examiner

CORE COMPRESSION AND FEEDER APPARATUS AND METHOD OF USING SAME

CROSS-REFERENCE TO RELATED APPLICATION

This application claims the benefit of U.S. Provisional Patent Application No. 62/643,889, filed Mar. 16, 2018, entitled "Core Compression and Feeder Apparatus and Method of Using Same," the contents of which are incorporated herein by reference.

FIELD OF INVENTION

The present disclosure generally relates to systems and methods for preparing packaging materials for shredding. More specifically, the present disclosure relates to systems and methods of compressing cores used as packaging members to prepare such cores for shredding so that such cores can be efficiently and effectively transported for subsequent recycling or disposal.

BACKGROUND

In today's consumer and industrial marketplace, most goods and products are sold with some type of accompanying packaging materials. End users are increasingly responsible for the management of such packing materials once the purchased good or product is removed from the packaging materials. Such management of packaging material can be both costly and time consuming for a commercial or industrial business. In one example, companies often spend a considerable amount of money and resources recycling or disposing of packaging materials. Disposal of such packaging materials can be through standard rubbish removal services, which may dictate the condition of the rubbish that is removed by the service (i.e., rubbish must be located in specifically sized rubbish receptacles, rubbish must be compressed and banded for ease of transportation, etc.). Alternatively, due to a company's internal policies or government regulation, it is not uncommon for businesses to incur an obligation to recycle certain packaging materials. Recycling processes often have standards for preparing the packaging materials for transportation and ultimately recycling. In any event, it is very common for businesses to compress, cut, and/or shred packaging material to prepare the materials for manageable transportation and disposal.

Packaging materials are often used to protect manufactured goods and products against damage as the goods are stored or shipped from a manufacturer to a distributor or end user. In order for such packaging material to properly protect the manufactured good or product, it is often necessary to make the packaging material in a configuration and of materials that are highly resistant to deformation or damage when subjected to forces, loads, and pressure. While such configurations and materials are designed to meet the primary need to protect the manufactured goods and products during storage and transportation, once the goods are removed from the packaging material and it is time to dispose of the packaging material, it can often be challenging to compress, cut, or shred the packaging material. As will be understood, the same properties that make such packaging material effective in protecting the goods and products, also make it difficult to compress, cut, or shred the packaging materials in preparation for transportation, recycling, and/or disposal.

One category of packing and packaging materials that are difficult to manage after the goods are removed are robust cardboard cores and tubes. Such robust cardboard cores and tubes are often used as an inner base for thin flexible goods and products that can be wrapped around such an inner base during storage and transit of the goods. Examples of uses for such robust cardboard cores and tubes include bulk paper products such as printing and writing paper, tissues, paper towels, and newsprint, and other goods such as carpeting and other flexible flooring products. "Master" rolls used in the manufacturing of such products are typically very long, for example, as long as ten or twelve feet. Furthermore, the cores are designed to be very strong and robust to resist compression and deformation as the cores need to withstand the weight of the goods wrapped around the core along the substantial length of the cores. As will be appreciated, the same properties that make such cores a good material for use with bulk paper products and carpeting and other flexible flooring surfaces, also make the cores particularly difficult to compress, cut, or shred once the bulk paper products or carpeting is removed. In fact, none of the prior art systems or methods effectively compress and cut/shred such cores so that the cores can be sufficiently compacted and baled for efficient and cost-effective transporting, recycling, and/or disposal of the cores.

Therefore, novel systems and methods are needed for the management of packaging materials such as cores after the removal of the goods and products protected by the packaging materials. This is particularly the case for the efficient and effective cutting and shredding of cores and subsequent compacting of the cores for transporting the cores.

SUMMARY

One embodiment of a core compressor includes a housing and a first pair of rollers and a second pair of rollers, both positioned in the housing. For each of the pair of rollers, an upper roller is positioned in vertical alignment relative to a lower roller. The first pair of the rollers is located proximate to a first end of the core compressor and the second pair of the rollers is located proximate to a second and opposing end of the core compressor. The upper roller of the first pair of rollers is located a first distance from the lower roller of the first pair of rollers. The upper roller of the second pair of rollers is located a second distance from the lower roller of the second pair of rollers. The first distance is greater than the second distance. Each roller includes at least one row of teeth extending generally perpendicularly away from the surface of the roller.

In another embodiment, a third pair of rollers are positioned within the housing between the first pair of rollers and the second pair of rollers. An upper roller of the third pair of rollers is positioned in vertical alignment relative to a lower roller of the third pair of rollers. The upper roller of the third pair of rollers is located a third distance from the lower roller of the third pair of rollers. The third distance is lesser than the first distance and greater than the second distance.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of apparatus, arrangements, and methods for compressing and shredding packaging materials such as robust cardboard cores are hereinafter disclosed and described in detail with reference made to FIGS. 1-17.

Disclosed herein are novel apparatus and methods for managing the volume of packaging materials such as highly robust cardboard cores by compressing such cores and subsequently cutting and/or shredding the compressed cores into more manageable sections that can be more efficiently compacted and baled for transit and/or recycling and disposal. In light of the lack of efficient machines and methods for cutting and/or shredding cardboard cores, it has been discovered that compressing the cores prior to cutting and/or shredding yields substantially better results than prior art methods. The apparatus and methods described herein are effective when the product is fully and completely removed from the core, but also effective when a portion of the product, such as remaining paper stock, remains on the core. Additionally, the apparatus and methods disclosed herein result in less airborne particulates (i.e., less dust and debris), faster shredding/cutting times, and ultimately more efficient baling of shredded materials than prior art apparatus and methods.

Figure 1:
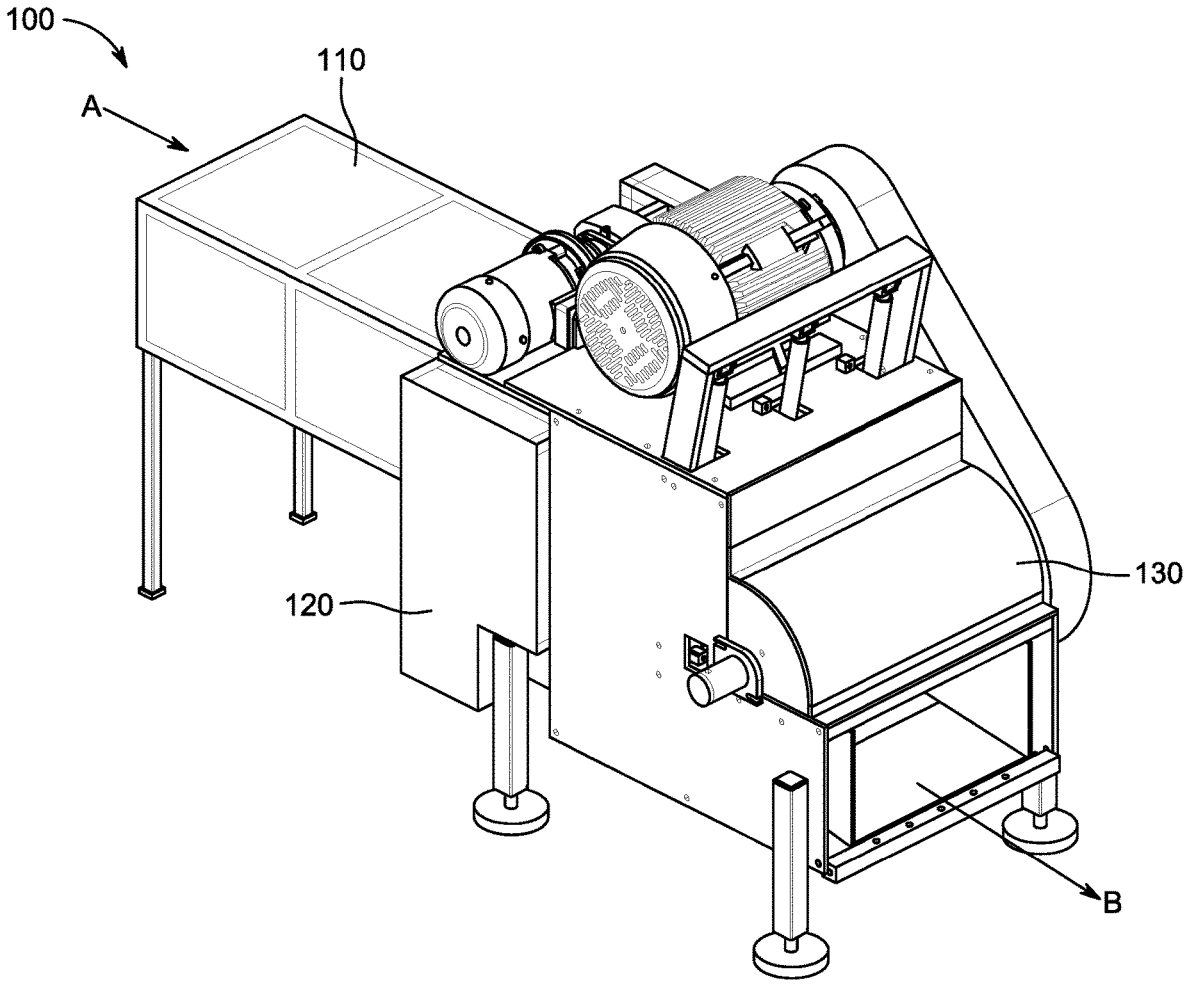
FIG. 1 schematically illustrates an exemplary perspective view of a core compression and shredding system.
Figure 2:
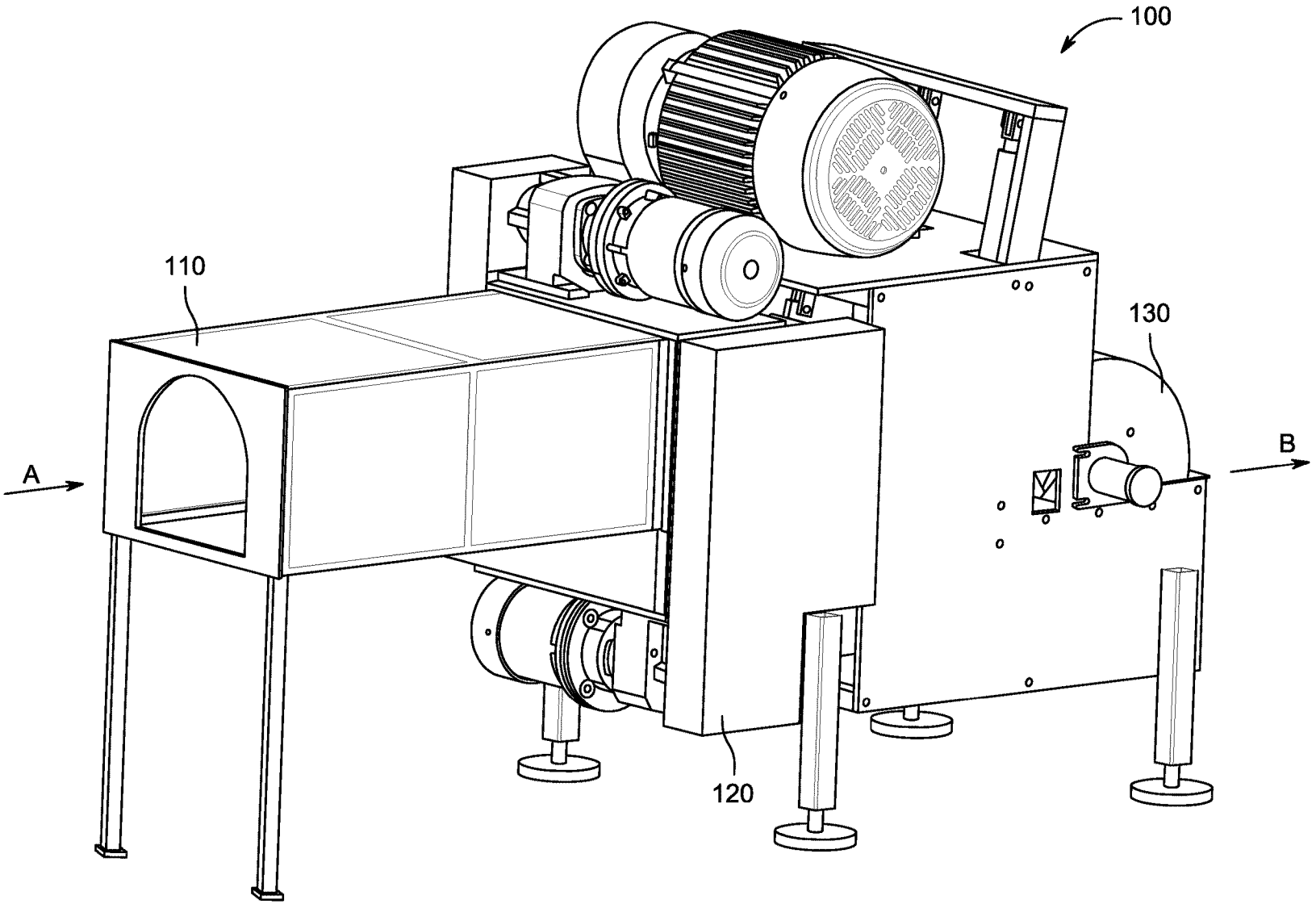
FIG. 2 schematically illustrates another exemplary perspective view of the core compression and shredding system of FIG. 1.

FIG. 1 and FIG. 2 illustrate a core compression and shredding system 100 for compressing a core and subsequently shredding the compressed core. The system includes a core feeder 110, a core compressor 120, and a core shredder 130. In one example, once a core has reached the end of its usefulness and the core is ready for disposal, the core can be fed into the core feeder 110 (as shown by directional line A). The core proceeds through the core feeder 110 and into the core compressor 120, where the core is compressed and otherwise manipulated until the core is substantially flattened. Once flattened, the cores continue on into core shredder 130, where the core is shredded and exits the core shredder 130 (as shown by directional line B). The core is compressed and shredded in a manner that yields smaller more manageable sections of core for subsequent baling and transportation to dispose of or recycle the materials. The core compression and shredding system 100 is described and illustrated as three separate subsystems that are joined together to form the compression and shredding system 100. However, it will be understood that other arrangements are contemplated in this disclosure. For example, one or more of the three subsystems can be joined into one subsystem; cores can be processed through the core feeder 110 and core compressor 120 and subsequently transferred to the core shredder 130; cores can be feed into the core compressor 120 without the use of the core feeder 110; and other such variations.

Figure 3:
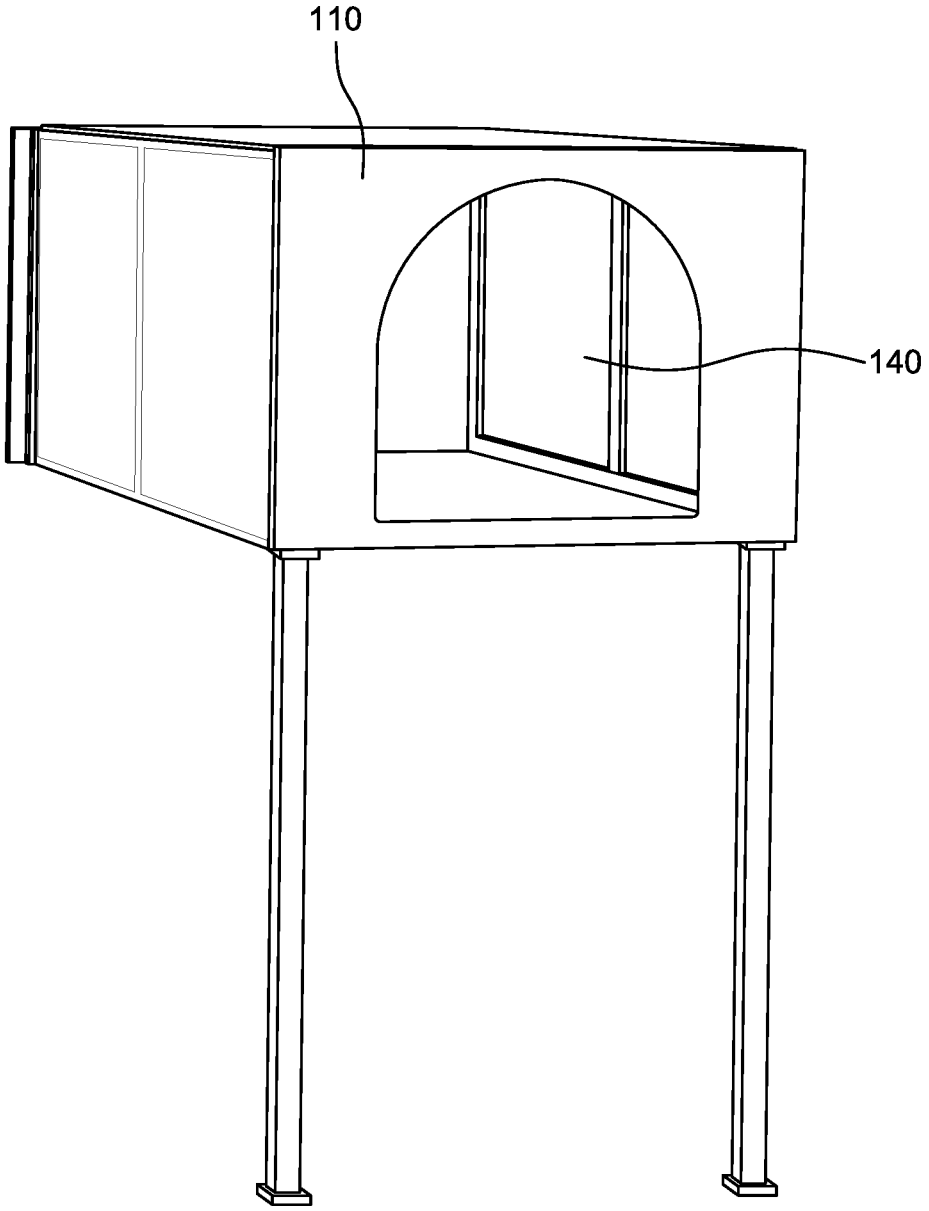
FIG. 3 schematically illustrates an exemplary perspective view of a core feeder for use with the core compression and shredding system of FIG. 1.
Figure 4:
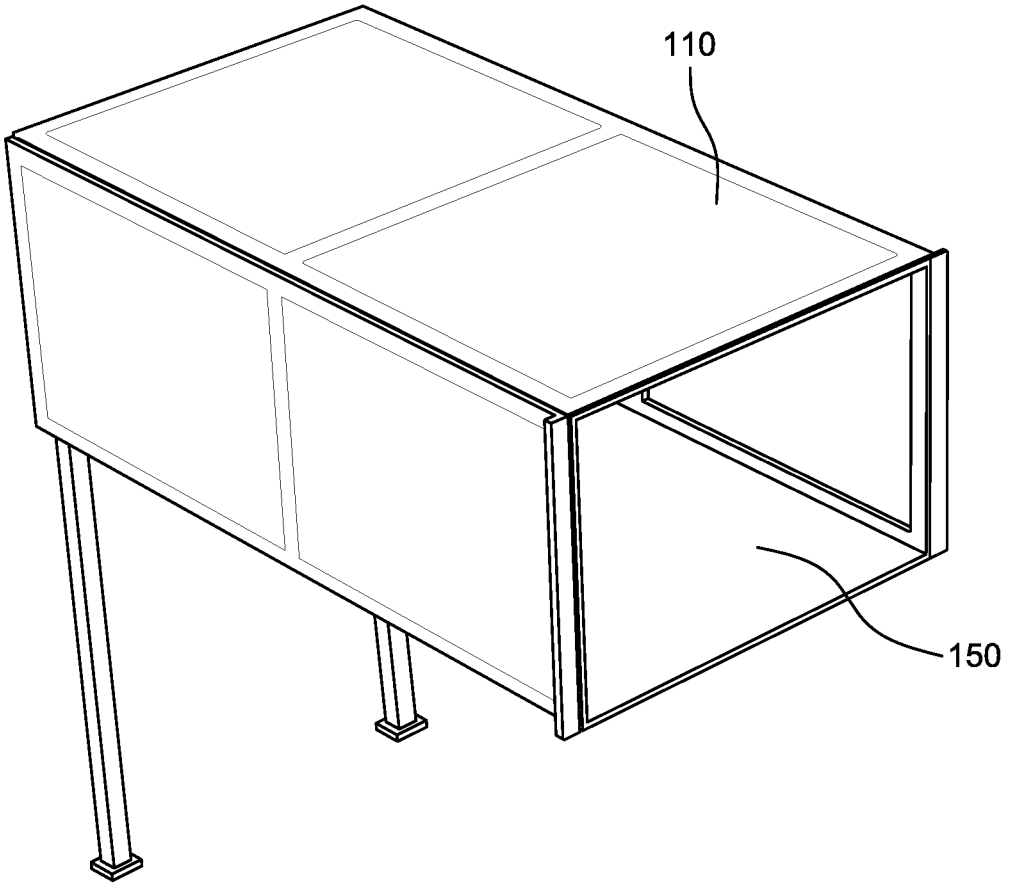
FIG. 4 schematically illustrates another exemplary perspective view of a core feeder for use with the core compression and shredding system of FIG. 1.

FIGS. 3 and 4 illustrate a pair of perspective views of the core feeder 110. The core feeder 110 includes a rear opening 140 and a front opening 150 and has a generally hollow interior. Cores are fed into rear opening 140 of the core feeder 110 and moved toward the front opening 150 of the core feeder 110, through which the cores enter the core compressor 120. It will be understood that the use of the core feeder 110 can assist in inserting cores into the core compression and shredding system 100 by controlling the number of cores that can be inserted at any one time and controlling the alignment of the cores as they are inserted into the core compression and shredding system 100. It will further be understood that the use of the core feeder 110 can provide for workers or automated equipment to insert cores into the core compression and shredding system 100 in a safe manner without exposing body parts or automated equipment to the element of the core compression and shredding system 100 that could cause bodily injury or damage to such equipment.

Figure 5:
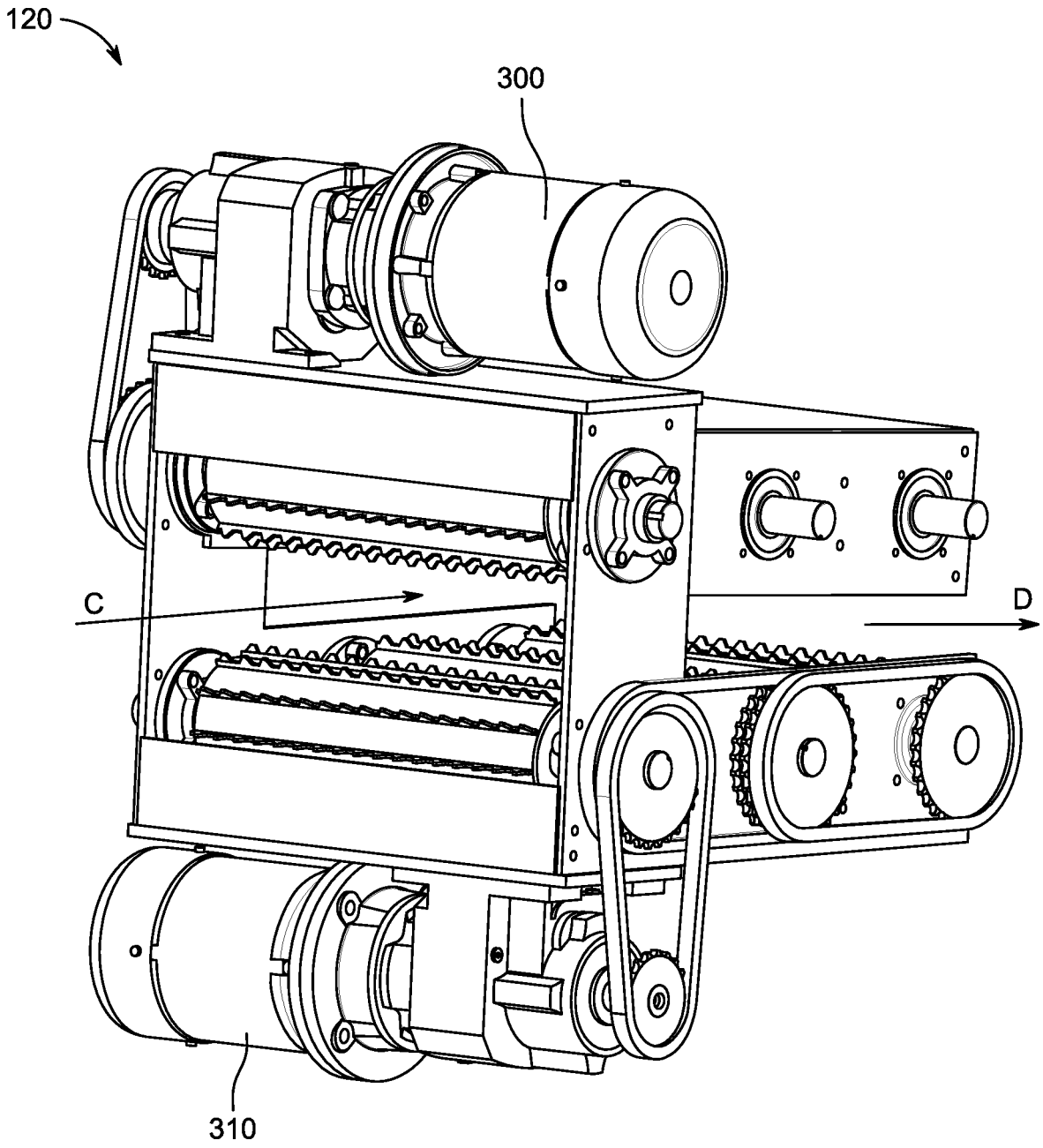
FIG. 5 schematically illustrates a perspective view of the core compressor for use with the core compression and shredding system of FIG. 1.
Figure 6:
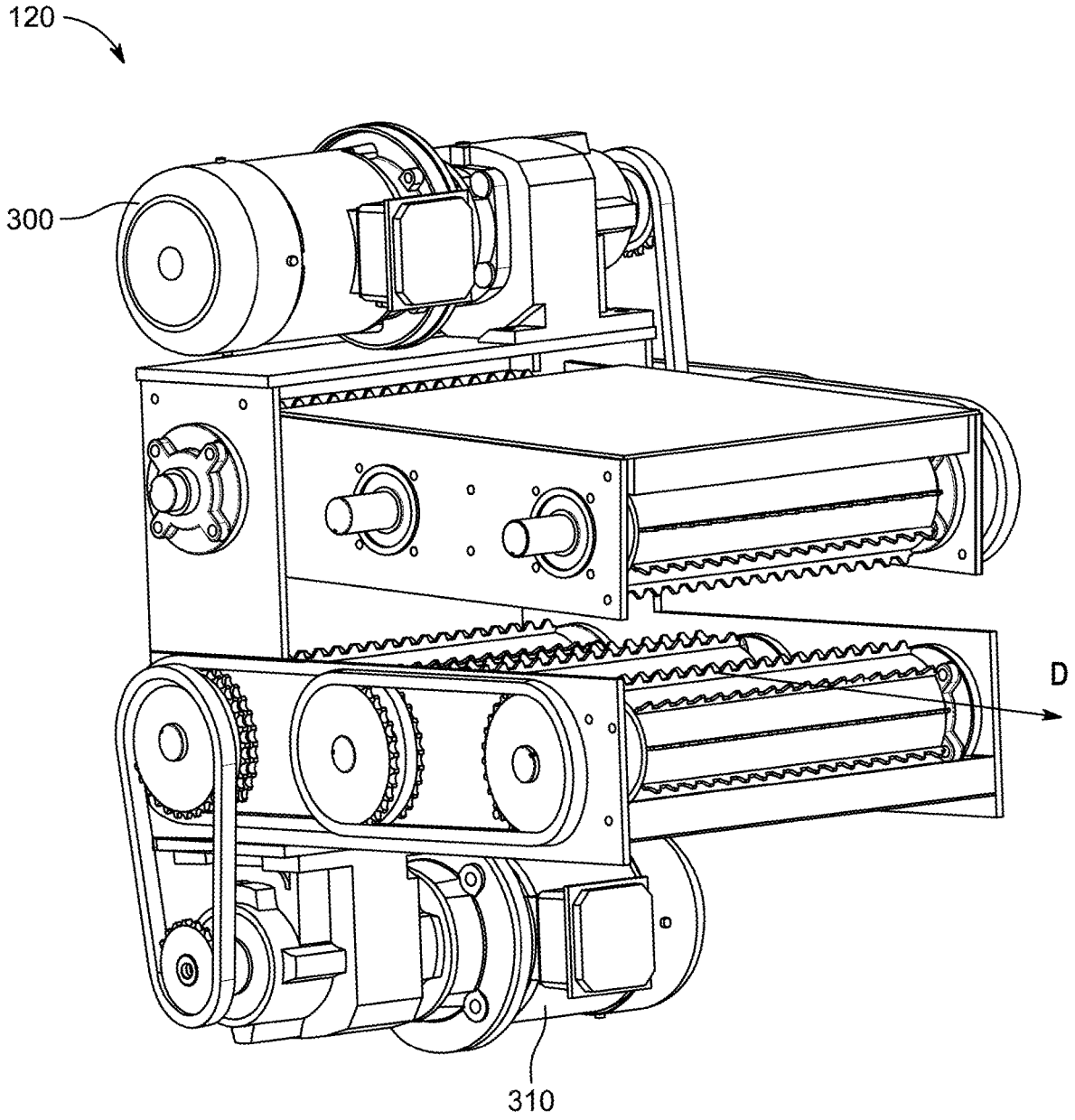
FIG. 6 schematically illustrates another perspective view of the core compressor for use with the core compression and shredding system of FIG. 1.
Figure 7:
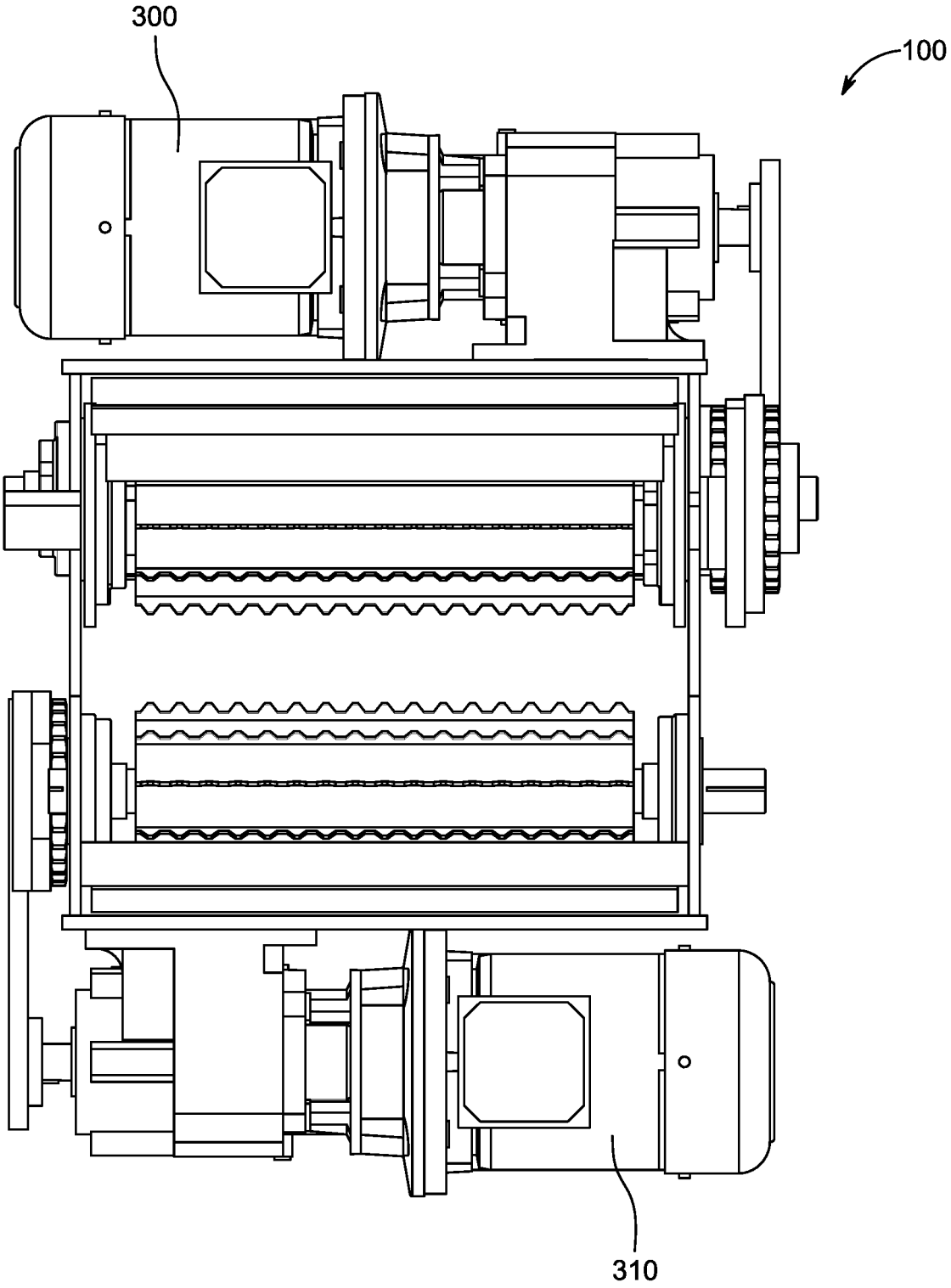
FIG. 7 schematically illustrates a front plan view of the core compressor.
Figure 8:
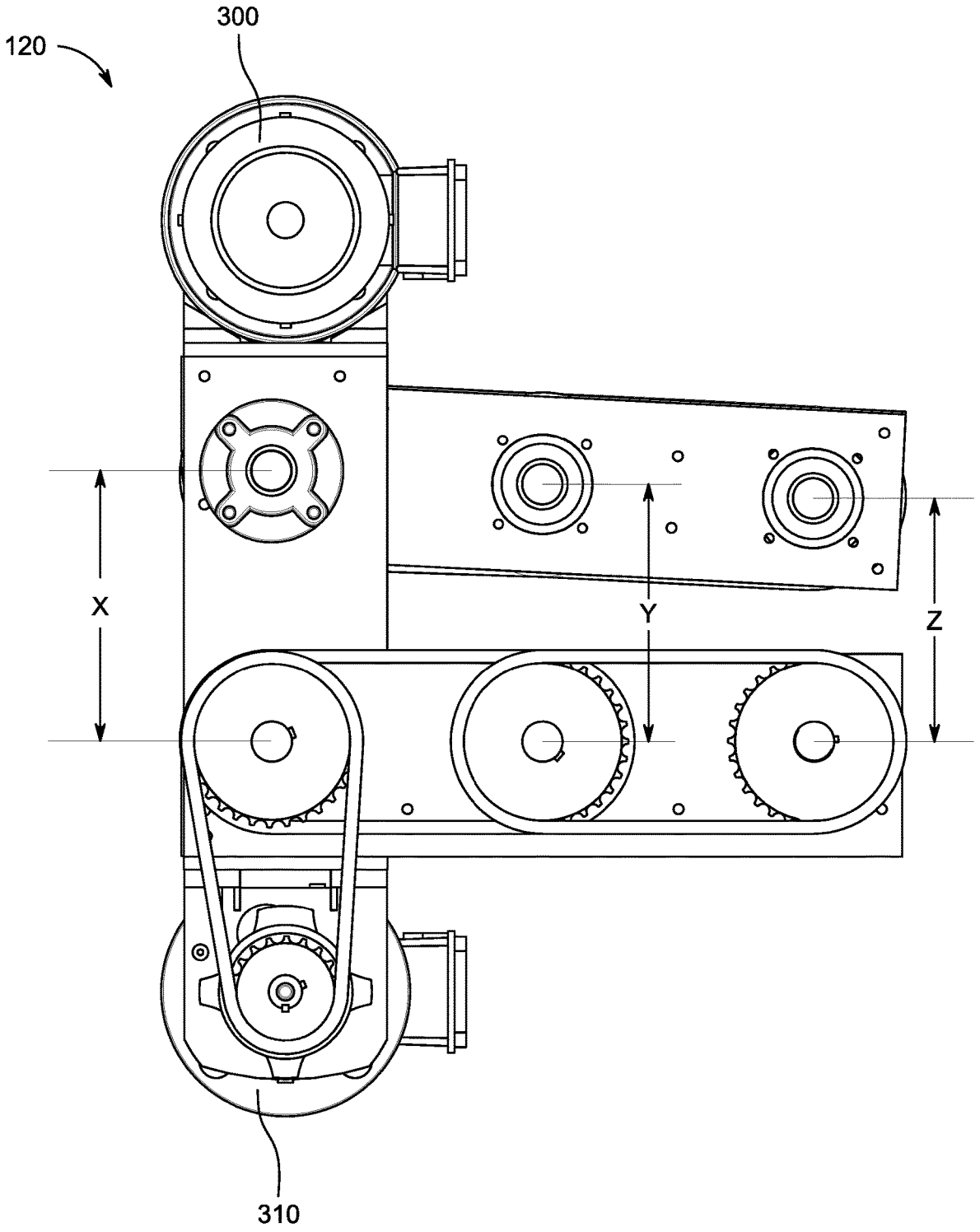
FIG. 8 schematically illustrates a side plan view of the core compressor.
Figure 9:
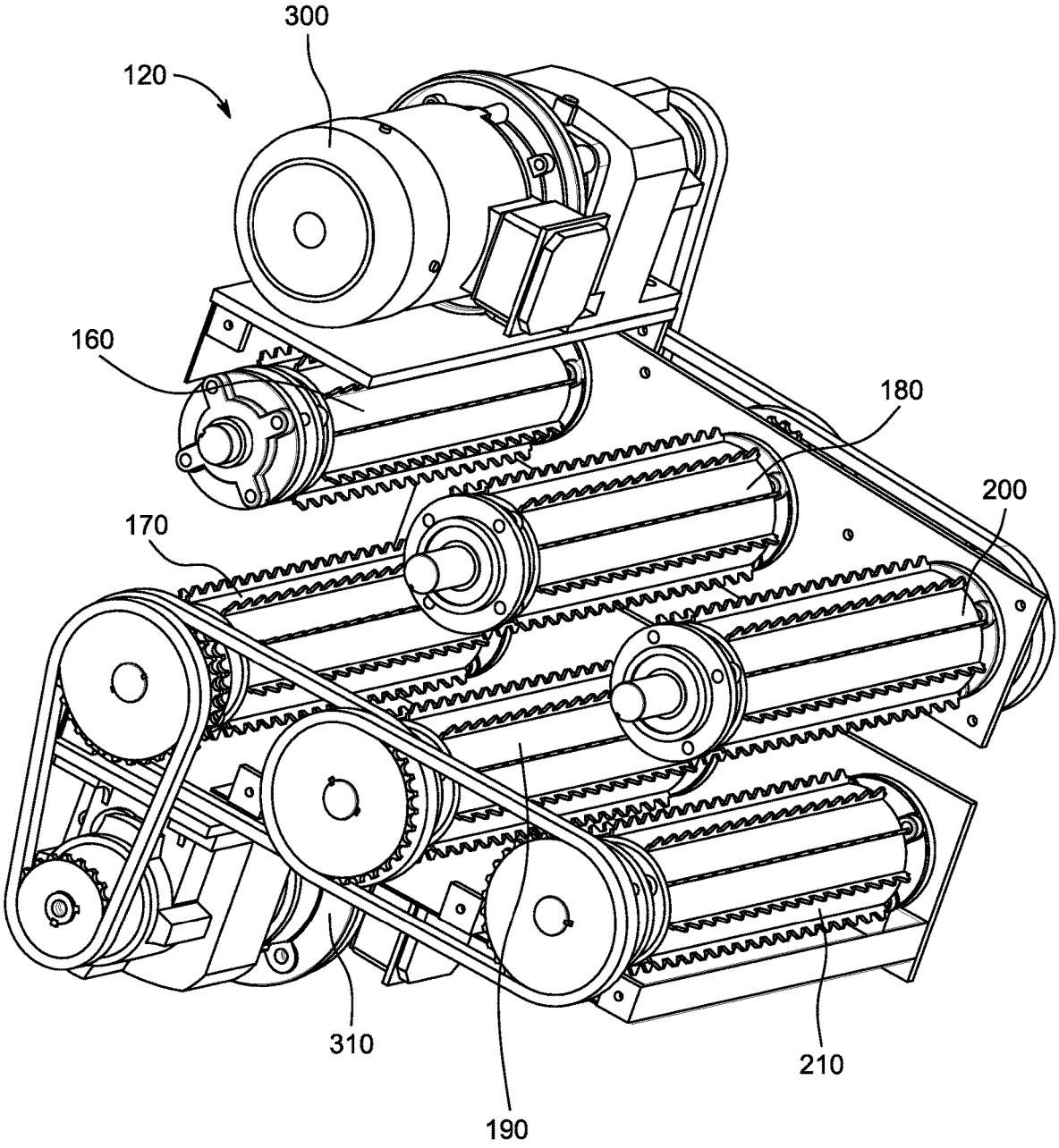
FIG. 9 schematically illustrates a perspective view of the core compressor with portions of the housing removed.

FIGS. 5-11 illustrate an exemplary embodiment of a core compressor 120. FIG. 5 is a perspective view of the core compressor 120 from a generally rear view of the core compressor 120, and FIG. 6 is a perspective view of the core compressor 120 from a generally front view of the core compressor 120. FIG. 7 is a front plan view of the core compressor 120, and FIG. 8 is a side plan view of the core compressor 120. Finally, FIG. 9 is a perspective view of the core compressor 120 with portions of the housing removed such that internal components of the core compressor 120 are revealed.

As previously described, cores are fed into the core feeder 110 through the rear opening 140 of the core feeder 110 and progress through the core feeder 110 until the core exits through the front opening 150, where it then enters the core compressor 120 as shown by directional line C. As will be subsequently described, upon entering the core compressor 120, the core progresses through the core compressor 120, where it is substantially manipulated and compressed so that the core is rendered generally flat. Once so compressed, the core can exit the core compressor 120 through a front opening of the core compressor 120 along the path generally illustrated by directional line D. Once the core exits the core compressor 120, it can be directly fed into the core shredder 130 or, if the core compressor 120 and core shredder 130 are not coupled, manually carried to or otherwise automatedly delivered to the core shredder 130 for further processing.

The core compressor 120 includes multiple pairs of rollers, which function to both move the core through the core compressor 120 and manipulate and compress the core as it progresses through the core compressor 120. As is described in detail herein, cores are physically manipulated to break down the structural integrity of the cores; thus, making it easier to compress and ultimately shred the cores.

As best illustrated in FIG. 9, in one embodiment, the core compressor 120 includes three pairs of rollers. The first pair of rollers includes a first upper roller 160 and a first lower roller 170. The first pair of rollers 160, 170 are located proximate to the rear opening of the core compressor 120 and positioned in general vertical alignment to one another. The second pair of rollers includes a second upper roller 180 and a second lower roller 190. The second pair of rollers 180, 190 are located at approximately the midpoint between the rear opening and the front opening of the core compressor 120 and also positioned in general vertical alignment to one another. The third pair of rollers includes a third upper roller 200 and a third lower roller 210. The third pair of rollers 200, 210 are located proximate to the front opening of the core compressor 120 and also positioned in general vertical alignment to one another. As will be further described, each pair of rollers are positioned generally in a vertical alignment to one another so that the rollers can work cooperatively to apply pressure or a compressive force to objects located between the rollers, such as the cores described herein.

As best illustrated in FIG. 8, in one embodiment, the spacing between each of the pair of rollers is unique to the pair of rollers. In the embodiment illustrated in FIG. 8, the distance between each pair of rollers decreases from the rear opening of the core compressor 120 to the front opening of the core compressor 120. This is to say, that the distance (X) between the first pair of rollers 160, 170 is greater than the distance (Y) between the second pair of rollers 180, 190, which is in turn greater than the distance (Z) between the third pair of rollers 200, 210. In one example, the distance (X) between the first pair of rollers 160, 170 is approximately ten inches, the distance (Y) between the second pair of rollers 180, 190 is approximately eight inches, and the distance (Z) between the third pair of rollers 200, 210 is approximately six inches. Such numeric examples are exemplary only. In other embodiments, the distances can be larger or smaller depending on the size, type, and configuration of material that is to be compressed.

Figure 10:
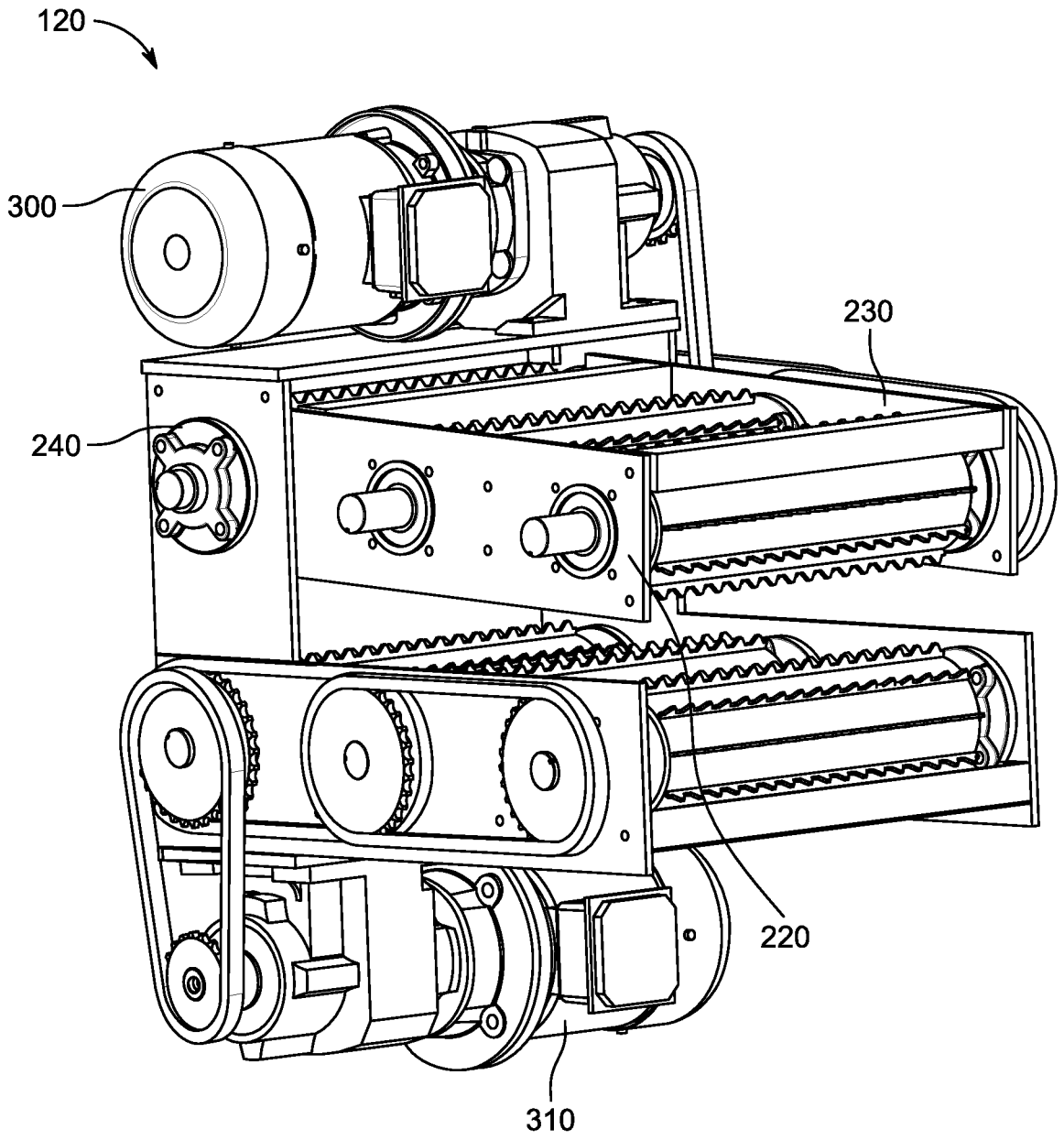
FIG. 10 schematically illustrates a perspective view of the core compressor with a portion of the housing removed.
Figure 11:
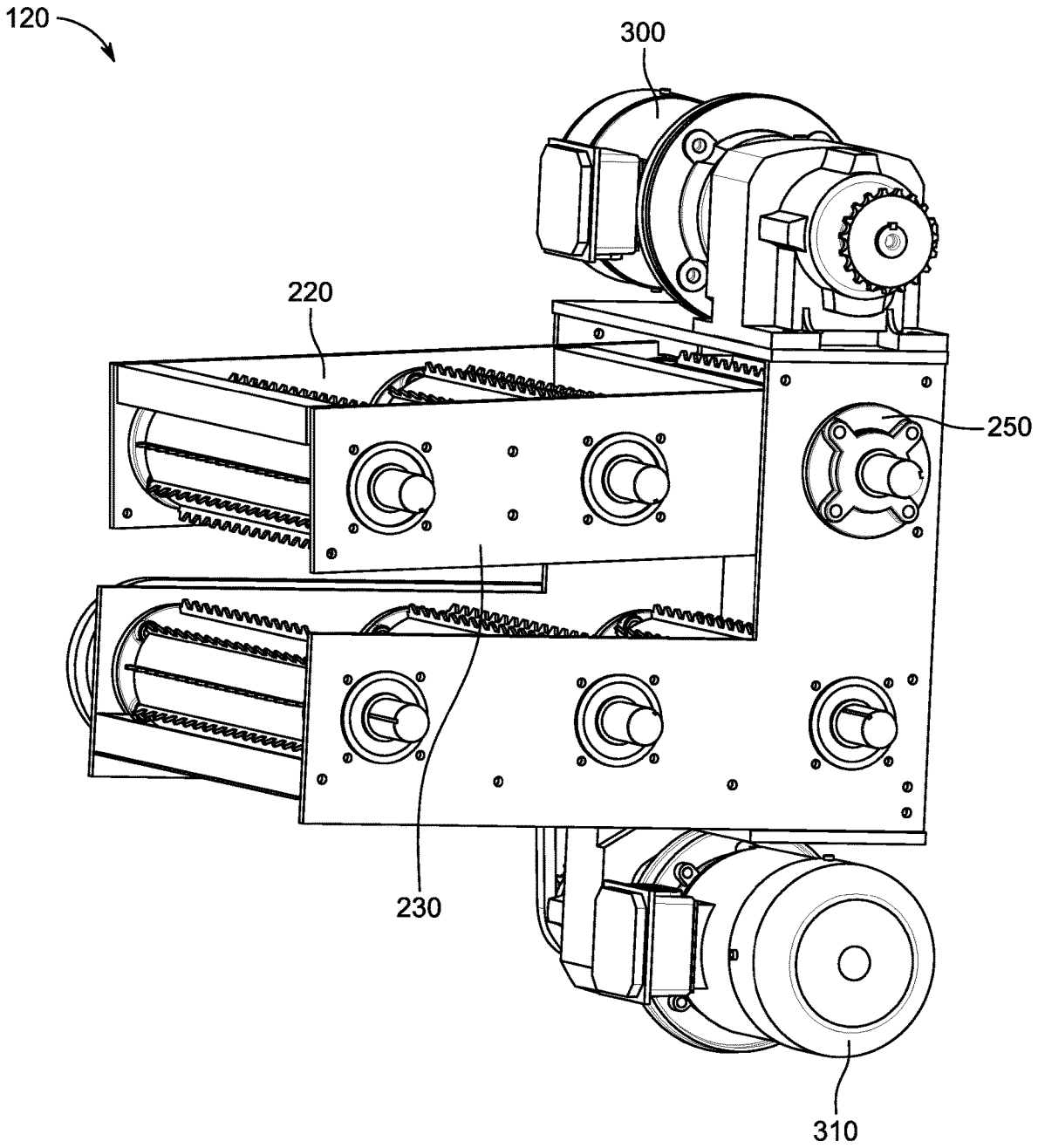
FIG. 11 schematically illustrates a perspective view of the core compressor with a portion of the housing and drive mechanism removed.

In one embodiment, the distances between pairs of rollers are not static, but is adjustable to accommodate various sizes of cores. In one example, one of each pair of rollers is adjustable in the vertical direction such that the distance between the pair of rollers can be increased or decreased by the repositioning of the adjustable roller. In another example, plates that secure the upper rollers to the core compressor 120 can be arranged to adjust the distance between pairs of rollers. Such an example is illustrated in FIGS. 10 and 11, where an upper portion of the housing is removed in both figures, while components of a drive mechanism are removed in FIG. 11 for ease of viewing and description. The upper rollers 160, 180, 200 are secured between a first plate 220 and a second plate 230, which join with a number of braces to secure the upper rollers 160, 180, 200 in position. The first plate 220 is secured to the housing by a first bearing mechanism 240 (as illustrated in FIG. 10), and the second plate 230 is secured to the housing by a second bearing mechanism 250 (as illustrated in FIG. 11). The first 240 and second 250 bearing mechanisms assist in securing the first 220 and second 230 plates, and thus the upper rollers 160, 180, 200, to the core compressor 120, but the first 240 and second 250 bearing mechanisms also create pivot points such that the first 220 and second 230 plates can pivot upward and downward about those pivot points. As will be understood, such pivoting motion can be useful in adjusting the distance between pairs of rollers.

Figure 12:
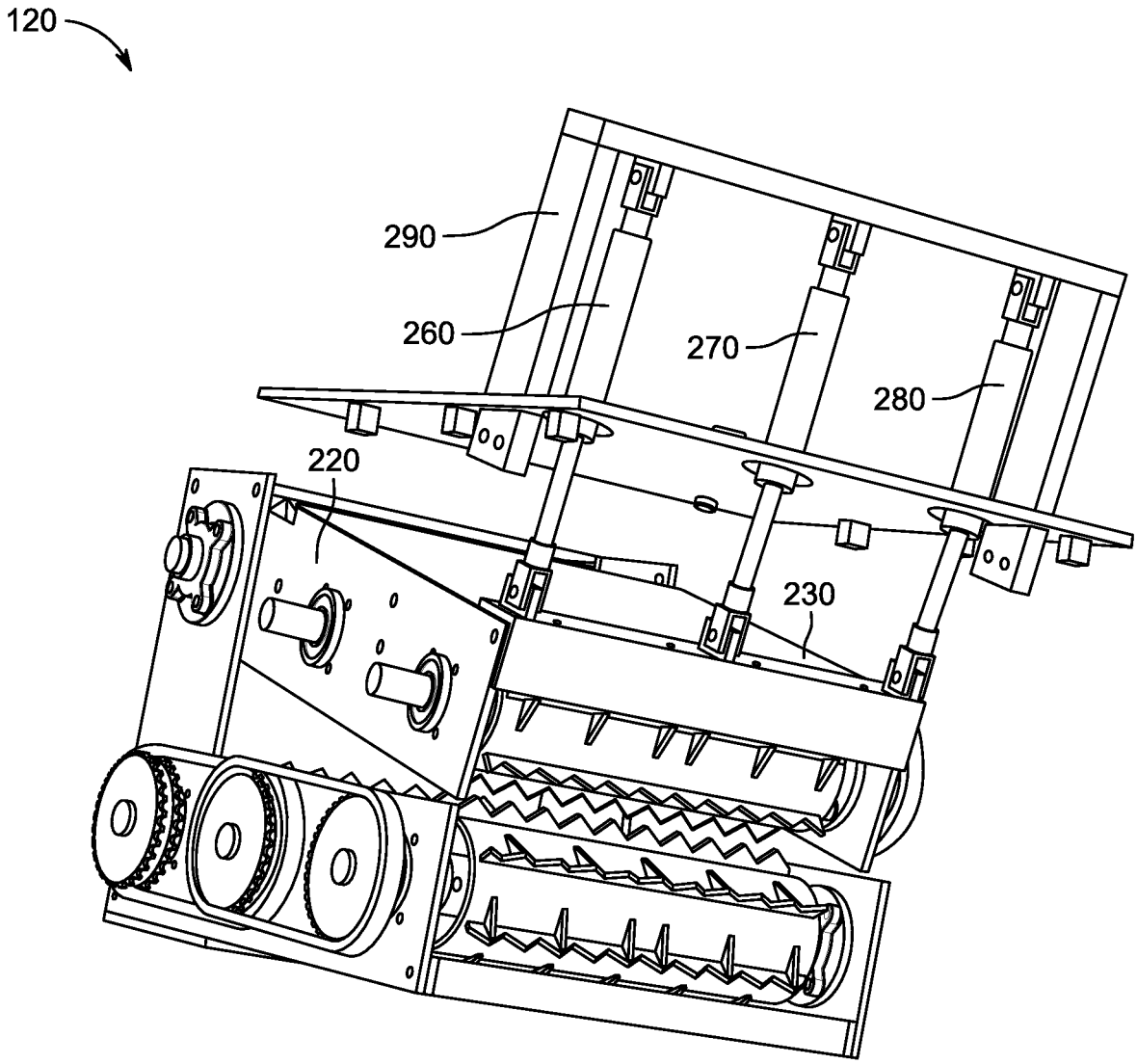
FIG. 12 schematically illustrates a perspective view of a core compressor with pistons engaged with the support plates.

The positioning of the first 220 and second 230 plates, and thus the positioning of the upper rollers (160, 180, 200) can be controlled by one or more pistons or other such dynamic mechanical component. FIG. 12 illustrates an exemplary core compressor 120 with many structural components removed to reveal internal components. As shown in FIG. 12, three pistons (260, 270, 280) are secured within the core compressor 120 such that the pistons (260, 270, 280) can apply a downwardly force onto the first 220 and second 230 plates, and thus apply a downwardly force on the upper rollers (160, 180, 200). By applying a downwardly force on the upper rollers (160, 180, 200), the pistons (260, 270, 280) can control the distance between the rollers and the force that the rollers can apply to a core as the core travels through the core compressor 120. It will be understood that the force applied by the pistons can be adjusted to accommodate cores of different sizes, cores made of different materials, cores of different wall thicknesses, etc. The pistons can be secured to a rigid support system 290 so that the requisite forces needed to compress and manipulate cores can be adequately provided. The travel of the pistons can be controlled by mechanical stops. The core compressor 120 can include a first mechanical stop that prevents the piston from extending beyond a certain distance, which will control the minimum distance between each pair of rollers and the pressure applied to the cores. A second mechanical stop can prevent the piston from retracting beyond a certain distance (in response to a counter force from the cores), which will control the maximum distance between the pairs of rollers and control the pressure applied to the cores.

The method of compressing a core is as follows. A used core is fed in the rear opening of core compressor 100. The first pair of rollers 160, 170 engage the core and begin to pull the core into the core compressor 120. The first pair of rollers 160, 170 apply a first pressure or compressing force onto the core to begin compressing the core. The core progresses through the core compressor 120 until the core engages with the second pair of rollers 180, 190, which has a shorter distance between the rollers 180, 190 than the distance between the first pair of rollers 160, 170. The second pair of rollers 180, 190 further pull the core through the core compressor 120 and apply a second pressure or compressing force on the core, further compressing the core. The core further progresses through the core compressor 120 until the core engages with the third pair of rollers 200, 210, which has a shorter distance between the rollers 200, 210 than the distance between the second pair of rollers 180, 190. The third pair of rollers 200, 210 further pull the core through the core compressor 120 and apply a third pressure or compressing force on the core, further compressing the core to generally flatten the core. The core progresses out of the front opening of the core compressor 120, where it can be fed into a core shredder 130. The result of this method is a core that is generally flattened, which can successfully be cut or shredded by the core shredder 130.

It will be understood that the distances between the rollers can be selected to process certain sizes of cores, cores constructed of different materials, or cores of various wall thicknesses. For example, the distance (X) between the first pair of rollers 160, 170 can be set to be about the same size or slightly smaller than the outer diameter of the core to be compressed. The distance (Z) between the third pair of rollers 200, 210 can be set to a size that is slightly larger than twice the wall thickness of the core to be compressed (i.e., the height of the core when flattened). The distance (Y) between the second pair of rollers 180, 190 can be set to a size that is between the distance (X) between the first pair of rollers 160, 170 and the distance (Z) between the third pair of rollers 200, 210.

While the embodiments described and illustrated herein include three pairs of rollers, this disclosure contemplates additional embodiments of less than three or more than three pairs of rollers. The number of pairs of rollers can be chosen for a number of reasons, such as to address different sizes, materials, or toughness of cores, to facilitate more rapid operation of the core compressing and core compression and shredding system 100, or to affect the incremental reduction in distances between pairs of rollers from the rear opening of the core compressor 120 to the front opening of the core compressor 120.

The core compressor 120 includes mechanisms for rotating the rollers to facilitate the compression and feeding of cores through the core compressor 120. As illustrated in FIGS. 5 through 11, the core compressor 120 includes a first motor 300 and accompanying belts and pulleys to drive the rotation of the upper rollers 160, 180, 200 and a second motor 310 and accompanying belts and pulleys to drive the rotation of the lower rollers 170, 190, 210. The motors 300, 310, and rollers can be configured such that a ten foot core can be compressed and fed through the core compression and shredding system 100 in approximately 5 to 10 seconds.

Figure 13:
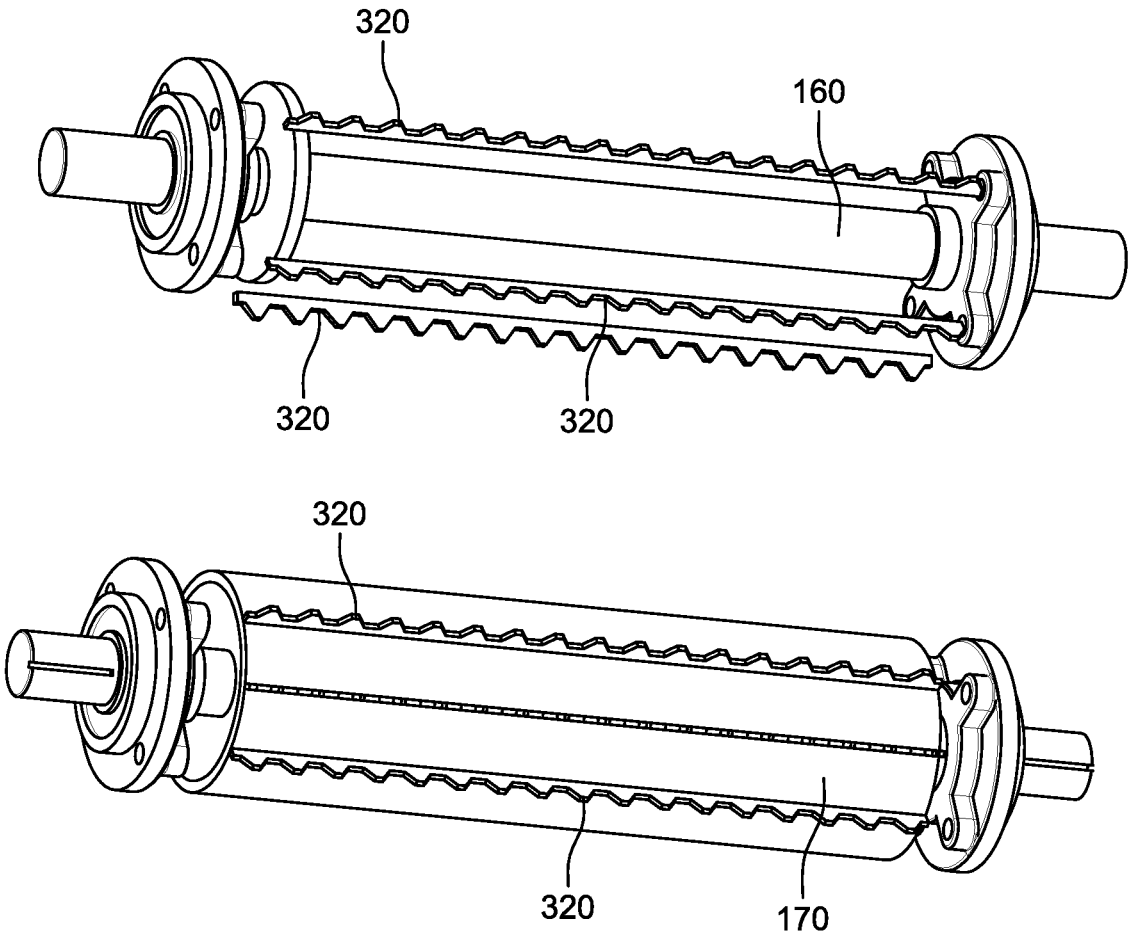
FIG. 13 schematically illustrates a perspective view of a pair of rollers for use with the core compressor.

The arrangement and configuration of the rollers assist in facilitating the compression of a core passing through the core compressor 120. FIG. 13 illustrates a detailed view of a pair of exemplar rollers 160, 170. The rollers 160, 170 include a number of rows of teeth 320 spanning the width of the rollers 160, 170. The rows of teeth 320 can serve two functional purposes. The first purpose is that when the rollers 160, 170 engage the core, the teeth 320 puncture the outer surface of the core so as to pull the core through the core compressor 120 as the rollers 160, 170 rotate. The second purpose is that as the teeth 320 puncture the outer surface of the core, such punctures degrade the structural integrity of the core, making the cores much more susceptible to compression under the pressure applied by the pairs of rollers.

Figure 14:
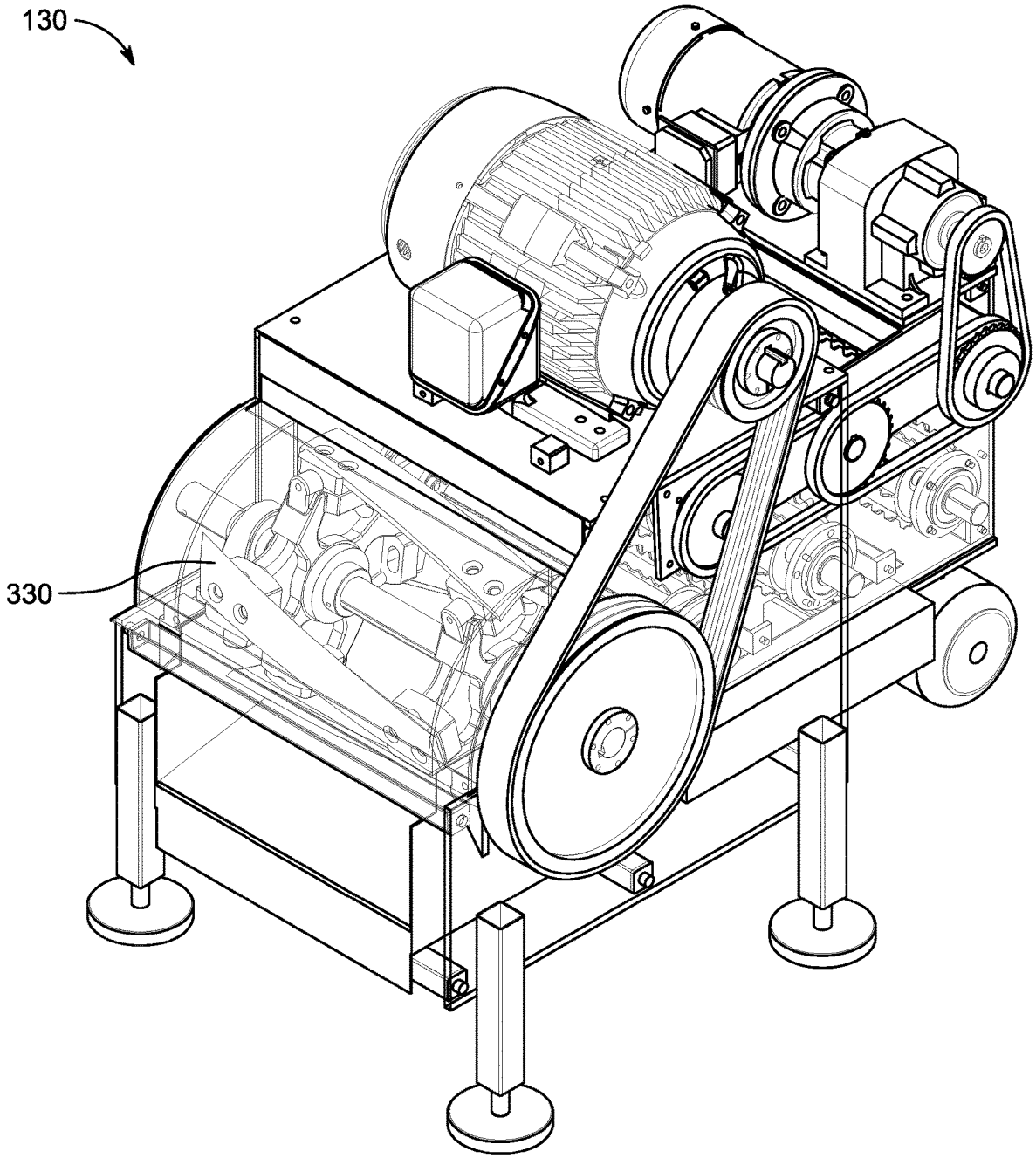
FIG. 14 schematically illustrates a core shredder for use with the core compression and shredding system of FIG. 1.

As described herein, once the cores are compressed to a generally flat configuration, the cores can be fed into the core shredder 130. As illustrated in FIG. 14, the core shredder 130 includes a series of rotating reel blades 330 that are effective in cutting and/or shredding the compressed core into smaller sections that can be efficiently and effectively baled for transport to a recycling or disposal facility.

Figure 15:
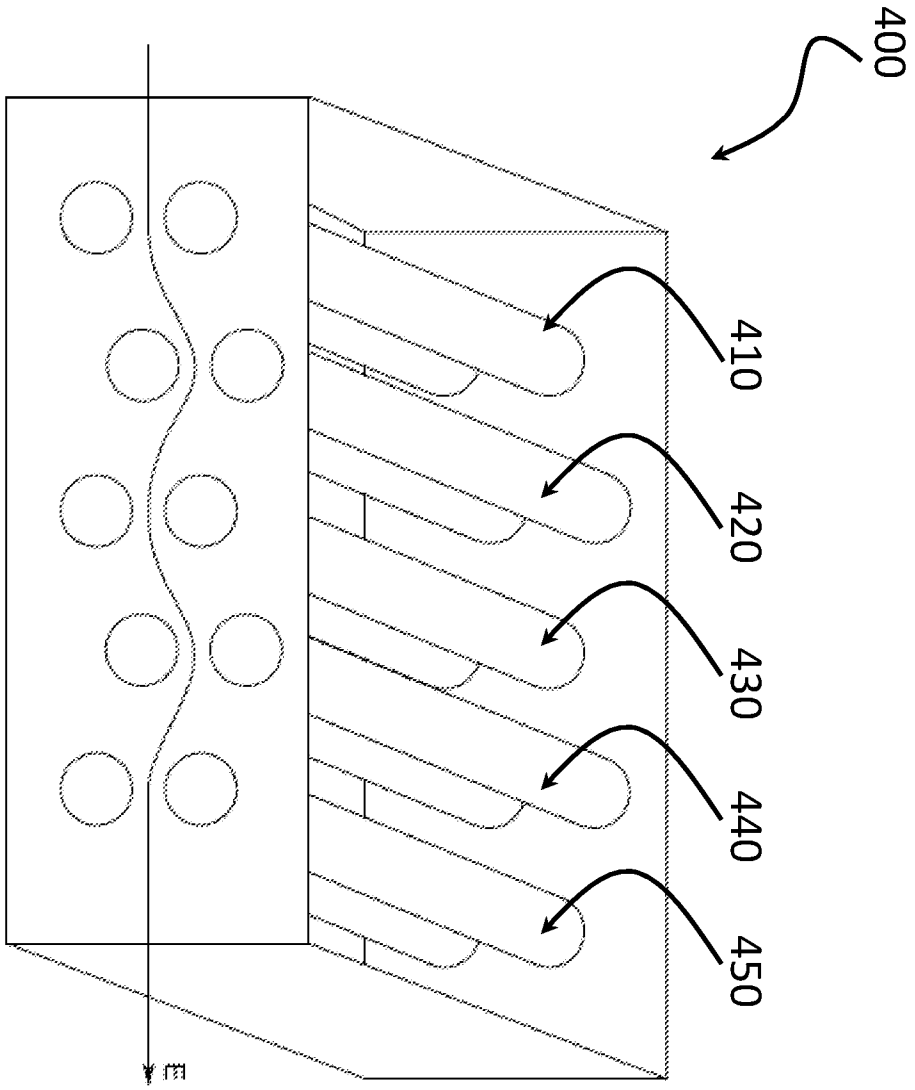
FIG. 15 schematically illustrates an alternative arrangement of pairs of roller for use with the core compressor.

The configurations of the rollers of the core compressor can be varied to facilitate the compression and manipulation of cores. In one example, a pair of rollers can be vertically offset from adjacent pairs of rollers such that the core is forced to move vertically as it progresses through the core compressor. FIG. 15 schematically illustrates such an arrangement. The example of FIG. 15 includes a core compressor 400 that includes five pairs of rollers (410, 420, 430, 440, and 450), each vertically offset from adjoining sets of rollers. As cores progress through the core compressor 400, the cores will move along a general serpentine path in a generally vertical plane as illustrated by the directional line E. For example, as the cores progress from the first set of rollers 410 and encounter the second set of rollers 420, which are located above the first set of rollers 410, the second set of rollers 420 will pull the core upward at an angle as it exits the first set of rollers 410; thus manipulating the cores and further breaking down the core's structural integrity. As the core progress from the second set of rollers 420 and encounter the third set of rollers 430, which are located below the second set of rollers 420, the third set of rollers 430 will pull the core downward at an angle as it exits the second set of rollers 420; thus further manipulating the core and further breaking down the core's structural integrity. This processes continues through the fourth 440 and fifth 450 sets of rollers as the cores progress through and ultimately exits the core compressor 400.

It will be appreciated that by forcing the core through the serpentine path E, the structural integrity of the core can be degraded such that it is more easily compresses and subsequently shredded.

Figure 16:
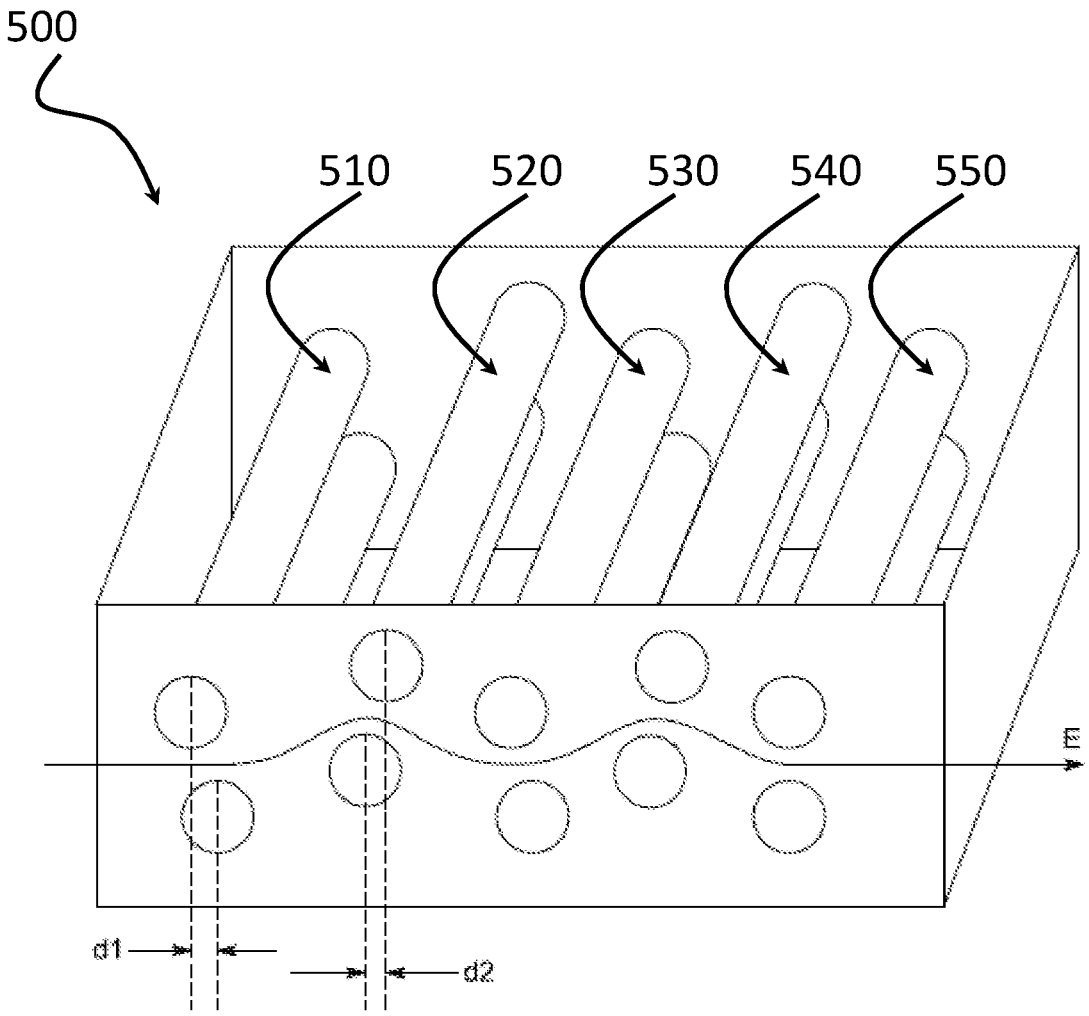
FIG. 16 schematically illustrates another alternative arrangement of pairs of roller for use with the core compressor.

FIG. 16 illustrates a core compressor 500 with another embodiment of vertically offset pairs of rollers (510, 520, 530, 540, and 550). For each pair of rollers, one of the rollers can be horizontally offset relative to the other roller. As illustrated in FIG. 16, the lower roller in the first pair of rollers 510 is offset to the right (relative to FIG. 16) by a distance d1 from its paired upper roller, and the upper roller in the second pair of rollers 520 is offset to the right by a distance d2 from its paired upper roller. This pattern continues for the third 530 and fourth 540 sets of rollers. Such an arrangement can help the core navigate the serpentine path E. By offsetting the lower roller of the first pair of rollers 510 to the right, the lower roller can apply a force that assists or causes the core to angle upward toward the second set of rollers 520. Conversely, by offsetting the upper roller of the second pair of rollers 520 to the right, the upper roller can apply a force that assists or causes the core to angle downward toward the third set of rollers 530. This pattern is repeated for the third 530 and fourth set of rollers 540. However, the fifth and final set of rollers 540 does not have one that is horizontally offset because it is more efficient to have the core exit the core compressor 500 horizontally.

In another example, pairs of rollers can be arranged at an angle as compared to the general path of the core through the core compressor such that the core is forced to move horizontally as it progresses through the core compressor.

Figure 17:
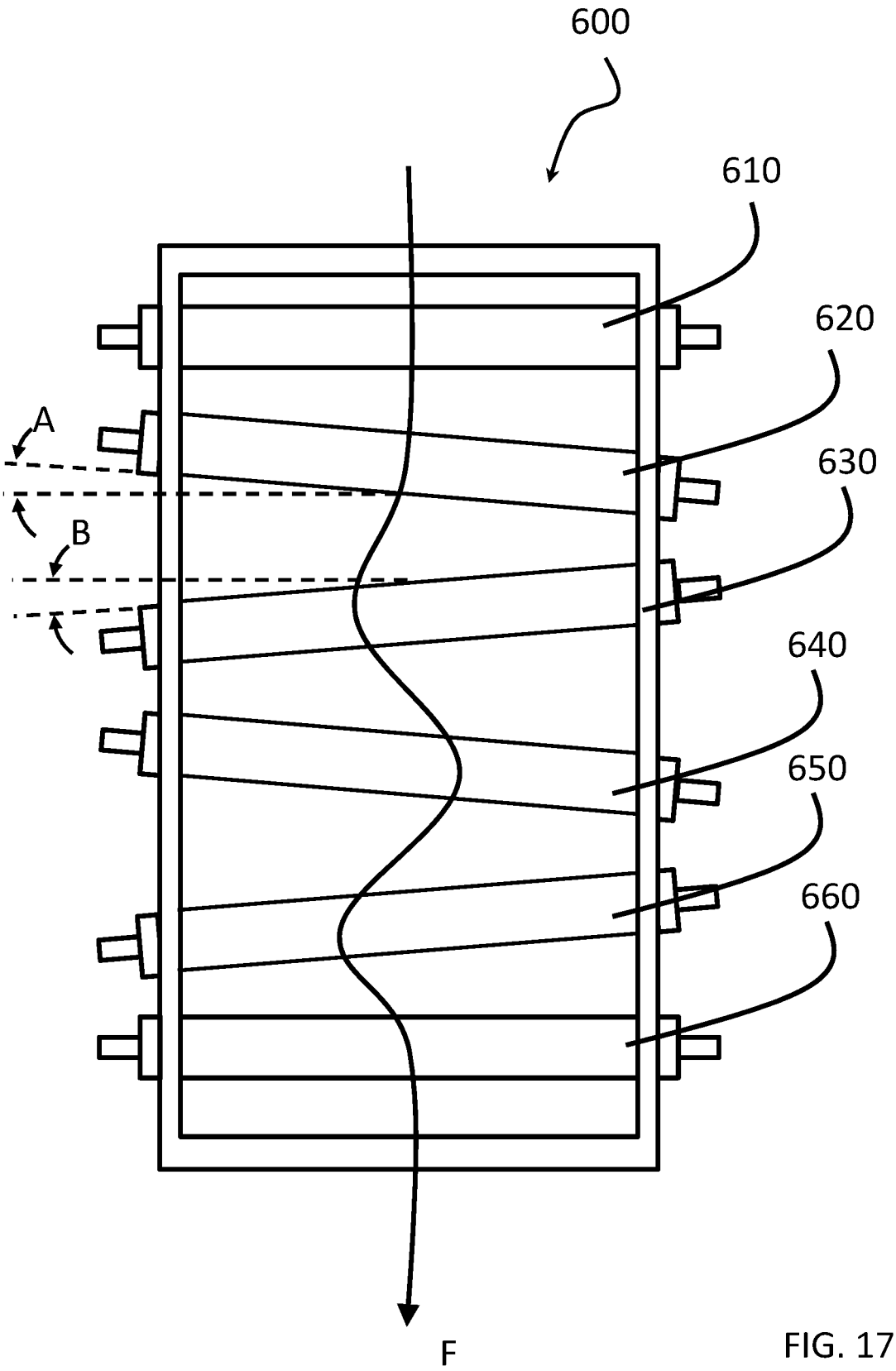
FIG. 17 schematically illustrates yet another alternative arrangement of pairs of roller for use with the core compressor.

FIG. 17 schematically illustrates such an arrangement in a topside view. The example of FIG. 17 includes a core compressor 600 with six pairs of rollers (610, 620, 630, 640, 650, and 660), where select pairs of rollers are situated at an angle. It will be understood that in the schematic illustration of FIG. 17, only the top roller is seen because the top roller obscures the view of the bottom roller. As the cores progress through the six sets of rollers, the cores will move along a general serpentine path in a generally horizontal path illustrated by the line F.

The first set of rollers 610 is generally arranged to be perpendicular to the general path of a core progressing through the core compressor 600. The first set of rollers 610 engage the core and feed the core toward the remainder of the rollers. The second set of rollers 620 is arranged at an angle A to the general path of a core progressing through the core compressor 600. Such an angled arrangement assists or causes the core to move toward the right (relative to FIG. 17). The core progresses toward the third set of rollers 630, which is arranged at an angle B to the general path of a core progressing through the core compressor 600. As illustrated, the angle A of the first set of rollers 610 and angle B of the second set of rollers 620 are of the same or similar size, but are angled in opposite directions. For example, angle A can be a 5 degree angle compared to a line that is perpendicular to the general path of the core progressing through the core compressor 600, whereas the angle B can be a −5 degree angle compared to a line that is perpendicular to the general path of the core progressing through the core compressor 600. The values of 5 and −5 for angles A and B respectively is a mere example. Angles A and B can be any number of values that result in the core proceeding through the core compressor 600 in a generally serpentine path.

Once the core engages with the third set of rollers 630, the angled rollers assist or cause the core to move toward the left (relative to FIG. 17). The core progresses toward the fourth set of rollers 640, which are arranged at an angle opposite the angle of the third roller set 630 and again changes the path of the core through the core compressor 600 as the core moves toward the fifth set of rollers 650. The fifth set of rollers 650 repeats this process. The sixth set of rollers 660 are illustrated as generally arranged to be perpendicular to the general path of a core progressing through the core compressor 600. Such an arrangement can assist in driving the core out of the core compressor in a generally straight line (as illustrated by direction line F). In another arrangement, the sixth set of rollers 660 may be arranged at a slight angle to compensate for the angle at which the core engages the sixth set of rollers 660 such that the core exits the core compressor in a generally straight line.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

We claim:

1. A core compressor apparatus comprising:

a housing comprising:

a rear opening;

a front opening;

a first frame assembly, and a second frame assembly;

a first upper roller rotatably secured to the first frame assembly proximate to the rear opening, the first upper roller including at least one row of teeth extending therefrom;

a first lower roller rotatably secured to the second frame assembly proximate to the rear opening, the first lower roller including at least one row of teeth extending therefrom and is positioned below and spaced apart from the first upper roller by a first vertical distance;

a second upper roller rotatably secured to the first frame assembly between the first upper roller and the front opening, the second upper roller including at least one row of teeth extending therefrom;

a second lower roller rotatably secured to the second frame assembly between the first lower roller and the front opening, the second lower roller including at least one row of teeth extending therefrom and is positioned below and spaced apart from the second upper roller by a second vertical distance;

a third upper roller rotatably secured to the first frame assembly proximate to the front opening, the third upper roller including at least one row of teeth extending therefrom;

a third lower roller rotatably secured to the second frame assembly proximate to the front opening, the third lower roller including at least one row of teeth extending therefrom and is positioned below and spaced apart from the third upper roller by a third vertical distance:

wherein the first upper roller, the first lower roller, the third upper roller, and the third lower roller are positioned perpendicularly to a path of travel from the rear opening to the front opening of the core compressor and the second upper roller and the second lower roller are positioned at a first angle to the path of travel from the rear opening to the front opening of the core compressor in which longitudinal axes of the second upper and lower rollers are angled from longitudinal axes of the first and third upper and lower rollers along the path of travel from the rear opening to the front opening, and the longitudinal axes of the first upper and lower rollers are parallel to the longitudinal axes of the third upper and lower rollers.

2. The core compressor apparatus of claim 1, wherein the first vertical distance is greater than the second vertical distance and the second vertical distance is greater than the third vertical distance.

3. The core compressor apparatus of claim 1, wherein the first frame assembly is arranged so that it can pivot about a point proximate to the first upper roller.

4. The core compressor apparatus of claim 3, further comprising at least one piston couple to the first frame assembly.

5. The core compressor apparatus of claim 4, wherein the second vertical distance and the third vertical distance are controlled by an amount of pressure applied to the first frame assembly by the piston.

6. The core compressor apparatus of claim 1, wherein the first angle is five degrees.

7. The core compressor apparatus of claim 1, wherein the third vertical distance is zero.

8. The core compressor apparatus of claim 1 further comprises:

a fourth upper roller rotatably secured to the first frame assembly between the second upper roller and the third upper roller, the fourth upper roller including at least one row of teeth extending therefrom;

a fourth lower roller rotatably secured to the second frame assembly between the second lower roller and the third lower roller, the fourth lower roller including at least one row of teeth extending therefrom and is positioned below and spaced apart from the fourth upper roller by a fourth vertical distance;

wherein the fourth upper roller and fourth lower roller are positioned at a second angle to the path of travel from the rear opening to the front opening of the core compressor.

9. The core compressor apparatus of claim 8, wherein the first angle and the second angle are of the same value and are angled in opposite directions.

10. The core compressor apparatus of claim 9, wherein first angle is five degrees and the second angle is negative five degrees.

11. The core compressor apparatus of claim 8, wherein the first vertical distance is greater than the second vertical distance, the second vertical distance is greater than the fourth vertical distance, and the fourth vertical distance is greater than the third vertical distance.

12. The core compressor apparatus of claim 8, wherein the first frame assembly is arranged so that it can pivot about a point proximate to the first upper roller.

13. The core compressor apparatus of claim 12, further comprising at least one piston couple to the first frame assembly.

14. The core compressor apparatus of claim 13, wherein the second vertical distance, the fourth vertical distance, and the third vertical distance are controlled by an amount of pressure applied to the first frame assembly by the piston.

* * * * *